US010825621B2

(12) United States Patent
Tsai et al.

(10) Patent No.: US 10,825,621 B2
(45) Date of Patent: Nov. 3, 2020

(54) KEYBOARD KEY STRUCTURE AND METHOD OF MANUFACTURING A KEYCAP OF A KEYBOARD KEY

(71) Applicants: LITE-ON ELECTRONICS (GUANGZHOU) LIMITED, Guangzhou (CN); LITE-ON TECHNOLOGY CORPORATION, Taipei (TW)

(72) Inventors: Che-Hui Tsai, New Taipei (TW); Te-Wei Li, New Taipei (TW); Chieh-Liang Hsiao, New Taipei (TW); Jen-Chieh Huang, Taipei (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 81 days.

(21) Appl. No.: 15/053,060

(22) Filed: Feb. 25, 2016

(65) Prior Publication Data

US 2017/0076881 A1 Mar. 16, 2017

(30) Foreign Application Priority Data

Sep. 16, 2015 (CN) ..... 2015 1 0594455

(51) Int. Cl.
*H01H 13/88* (2006.01)
*H01H 9/18* (2006.01)

(52) U.S. Cl.
CPC ..... *H01H 13/88* (2013.01); *H01H 9/18* (2013.01); *H01H 2009/187* (2013.01); *H01H 2219/034* (2013.01); *H01H 2229/02* (2013.01)

(58) Field of Classification Search
CPC ..... H01H 9/18; H01H 13/70; H01H 13/88; H01H 2009/187; H01H 2219/034; H01H 2229/02
See application file for complete search history.

(56) References Cited

U.S. PATENT DOCUMENTS 7,364,649 B2 * 4/2008 Kunthady ..... H01H 13/14 205/118
8,853,577 B1 * 10/2014 Tom ..... H01H 13/83 200/314

(Continued)

FOREIGN PATENT DOCUMENTS

CN 2908498 * 6/2007 ..... C08J 5/18
CN 101333325 * 12/2008 ..... C08L 55/02

(Continued)

*Primary Examiner* — Matthew G Marini
*Assistant Examiner* — Marissa Ferguson-Samreth
(74) *Attorney, Agent, or Firm* — Li & Cai Intellectual Property (USA) Office

(57) ABSTRACT

A keyboard key structure includes a plurality of keycaps. Each keycap has a keycap body and an outward layer. The keycap body has an appearance with a first color. The outward layer has an appearance with a second color different from the first color. The outward layer is formed above the keycap body. The outward layer is formed with an engraving portion. The first color is exposed in the engraving portion. The present invention also provides a method of manufacturing a keycap of a keyboard key.

16 Claims, 3 Drawing Sheets

(56) References Cited

U.S. PATENT DOCUMENTS

| | | | | |
|---|---|---|---|---|
| 2001/0051254 | A1* | 12/2001 | katori | H01H 13/702 428/189 |
| 2010/0051431 | A1* | 3/2010 | Yeh | H01H 3/125 200/314 |
| 2010/0187079 | A1* | 7/2010 | Dumont | H01H 13/83 200/341 |
| 2010/0253551 | A1* | 10/2010 | Tsai | H01H 13/83 341/22 |
| 2011/0114462 | A1* | 5/2011 | Hu | H01H 13/705 200/5 A |
| 2015/0131291 | A1* | 5/2015 | Pun | H01H 13/83 362/293 |

FOREIGN PATENT DOCUMENTS

| | | | | | |
|---|---|---|---|---|---|
| CN | 201247707 | Y | | 5/2009 | |
| CN | 202172038 | U | | 3/2012 | |
| CN | 105694694 | | * | 6/2016 | C09D 175/04 |
| JP | 2004-126409 | | * | 4/2004 | |
| KR | 2003-826892 | | * | 6/2003 | H01H 13/70 |
| TW | M349521 | U | | 1/2009 | |

* cited by examiner

KEYBOARD KEY STRUCTURE AND METHOD OF MANUFACTURING A KEYCAP OF A KEYBOARD KEY

BACKGROUND OF THE INVENTION

1. Field of the Invention

The instant disclosure is related to a keyboard key structure and method of manufacturing a keycap of a keyboard key. In particular, the instant disclosure relates to a keyboard key structure using laser engraving to form a symbol on a keycap thereof.

2. Description of Related Art

A keyboard is widely used to input letters, numbers or signs to various electronic devices, such as computer, portable electronic device . . . etc. The characters or symbols are mostly formed on a top surface of a keycap by printing. Such a way needs to store a lot of keyboards of different languages which are printed in advance and available for sale or distribution, but causes a stocking burden.

For improving the stocking burden, a conventional way uses laser engraving to form characters and symbols of a specific language on the keyboard keys before delivering the goods, so as to reduce inventory pressure.

However, the method of laser engraving easily damages the keycap, especially as an engraving depth is hard to control accurately, which is why it is easy to injure the keycap body or character layer (or bottom layer). Therefore, a conventional keyboard usually has a protecting layer formed on a top surface of the character layer for protection from damage by the laser. This way is not only time-consuming and laborious, but also increases a thickness of the keycap.

SUMMARY OF THE INVENTION

It is one objective of this invention to provide a keyboard key structure, having a character layer which does not need a protecting layer additionally formed thereon, so as to reduce a thickness of the keycap.

In order to achieve the above objectives, according to one exemplary embodiment of the instant disclosure, the instant disclosure provides a keyboard key structure, which includes a plurality of keycaps. Each of the keycaps includes a keycap body and an outward layer. The keycap body has an appearance showing a first color, and the outward layer has an appearance showing a second color different from the first color. The outward layer is arranged above the keycap body. The outward layer has an engraving portion, and the first color is exposed in the engraving portion.

One more objective of this invention is to provide a method of manufacturing a keycap of keyboard key, and the keycap preferably has no concaved portions on a top surface thereof after layer engraving.

In order to achieve the above objectives, according to one exemplary embodiment of the instant disclosure, the instant disclosure provides a method of manufacturing a keycap of keyboard key, including at least the steps as follows:

Forming a keycap body, and having an appearance with a first color;

Forming an outward layer, and having an appearance with a second color different from the first color, wherein the outward layer is formed above the keycap body;

Forming a transparent protecting layer, covering on the outward layer; and

Forming an engraving portion on the outward layer in an engraving manner by a laser passing through the protecting layer, wherein the engraving portion is under a bottom surface of the protecting layer.

Thus, the instant disclosure has advantages as follows. The character layer of the keyboard key structure of the instant disclosure does not need an additional protecting layer, so that a thickness of the keycap can be reduced.

For further understanding of the instant disclosure, reference is made to the following detailed description illustrating the embodiments and examples of the instant disclosure. The description is for illustrative purpose only and is not intended to limit the scope of the claim.

DETAILED DESCRIPTION OF THE PREFERRED EMBODIMENTS

First Embodiment

Figure 1:
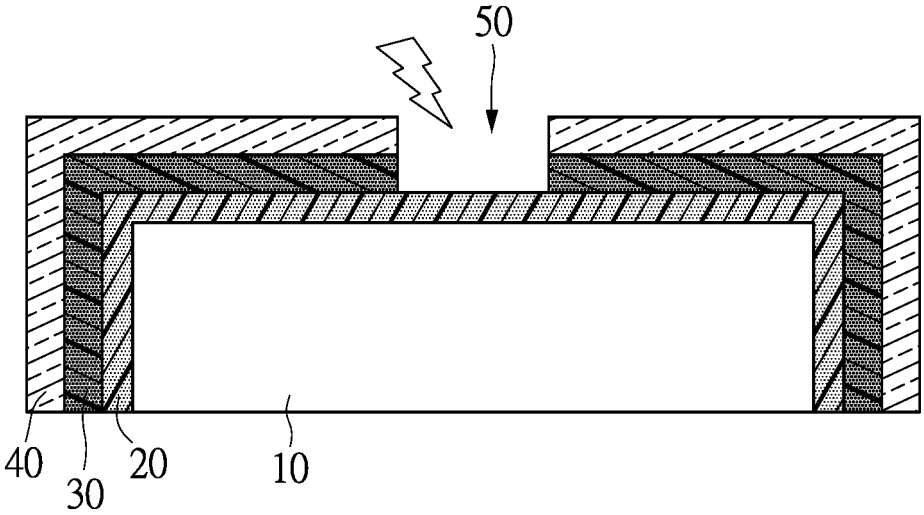
FIG. 1 is a cross-sectional view of a keyboard key structure of first embodiment according to the instant disclosure.

Refer to FIG. 1, which is a cross-sectional view of a keyboard key structure of first embodiment according to the instant disclosure. The instant disclosure provides a keyboard key structure, which includes a plurality of keycaps. In FIG. 1, there is only one keycap shown as a representative one. Each keycap has a keycap body 10. The keycap body 10 has an appearance showing a first color. The first color preferably is a lighter color, such as white, gray or yellow. The keycap further has an outward layer 30. The outward layer 30 has an appearance showing a second color different from the first color. The outward layer 30 is formed on the keycap body 10. The second color could be a darker color, such as black or dark blue.

In this embodiment, a character layer 20 with the first color is spread on a top surface of the keycap body 10. The first color is provided by the character layer 20. In this condition, the outward layer 30 is formed on a top surface of the character layer 20. However, the first color of this present disclosure can be provided by the keycap body 10, which will be described in a later embodiment. In this embodiment, the keycap further has a protecting layer 40 formed on a surface of the outward layer 30. The protecting layer 40 preferably is transparent and the second color is exposed through the protecting layer 40, which has a function for protecting the keycap.

The final step of this present disclosure of manufacturing the keyboard key structure is that, utilizing a laser beam to engrave the keycap and forming an engraving portion 50, and the engraving portion 50 passes through the outward layer 30 to expose the first color. The shape of the engraving portion 50 corresponds to the required language of the keyboard. In this embodiment, the engraving portion 50 passes from an outer surface of the protecting layer 40 through the outward layer 30 and extended until reaching a top surface of the character layer 20. When a specific language of keyboard is required, the keys are proceeded with the engraving process to form characters and symbols. Such a manufacturing way has the advantage that, it does not need to print the required language on the keycap in advance, so that there is no condition for keeping keyboards of certain languages in stock.

In this embodiment, the character layer 20 preferably is added with 1% to 10% weight percent of protective wear-resistant agent. Thus, during the laser engraving process, the keycap is not easily abraded by engraving, and passes environmental testing. The protective wear-resistant agent includes at least one of the following inorganic materials: silicon dioxide, ceramic powder, corrosion inhibitor, epoxy resin, Polyacrylamide (PAM), nano-silicon dioxide (whose particle size about 1 to 100 nanometer), talcum powder, aluminum tristearate, calcium stearate, or low-molecular thermoplastic resin. The nano-silicon dioxide, also called as super-fine silicon dioxide, has a nanoparticle (super small) grade, with the functions of anti-ultraviolet, aging resistance, material strength and chemical resistance.

Moreover, the protecting layer 40 can be added with 1% to 10% weight percent of laser-engraving assisted material for easily processing laser engraving. The laser-engraving assisted material can be laser engrave powder. The laser engrave powder could be black or silver color materbatches. The materbatch is a colorant of macromolecule material, which usually includes pigment (dye), carrier and additive . . . etc. In addition, the protecting layer 40 can be added with 1% to 10% weight percent of chemical resistant material. The chemical resistant material can be chosen from at least one of the following materials: inorganic particles, sol-gel, polymethylmethacrylate (PMMA), polyurethane, dispersant, antioxidant, ultraviolet absorber, polyether-modified organic-silicones, oxidized high-density polyethylene wax, carnauba wax, or polyethylene wax. Therefore, its transmittance can be raised.

Second Embodiment

Figure 2:
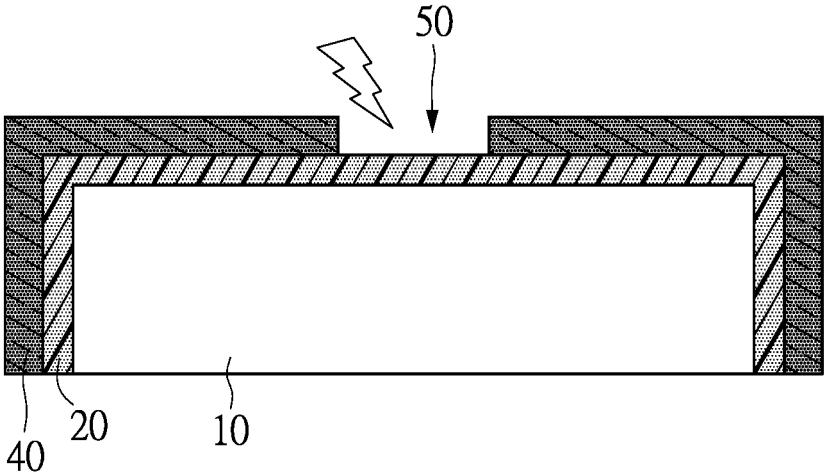
FIG. 2 is a cross-sectional view of a keyboard key structure of second embodiment according to the instant disclosure.

Refer to FIG. 2, which is a cross-sectional view of a keyboard key structure of second embodiment according to the instant disclosure. The difference between this embodiment and the above embodiment is that, an outward layer is omitted in this embodiment. The keycap includes a keycap body 10, a character layer 20 with the first color, and a protecting layer 40 formed on an outer surface of the character layer 20. The character layer 20 is spread on a top surface of the keycap body 10. The protecting layer 40 can be colored with the second color. A part of the protecting layer 40 is removed, so that the character layer 20 with the first color is exposed.

Similar to the first embodiment, the character layer 20 is preferably added with 1% to 10% weight percent of protective wear-resistant agent. Thus, the keycap can be protected and is not easily damaged during the laser engraving process, and passes an environmental test. The composition of the protective wear-resistant agent can be the same as that mentioned in the first embodiment.

The protecting layer 40 can be added with 1% to 10% weight percent of laser-engraving assisted material, so as to process the laser engraving easily. The composition of the laser-engraving assisted material can be the same as that of the first embodiment. The protecting layer 40 also can be added with some material to enhance chemical resistance, such as 1% to 10% weight percent of chemical resistant material. The composition of the chemical resistant material can be the same as that mentioned in the first embodiment.

Third Embodiment

Figure 3:
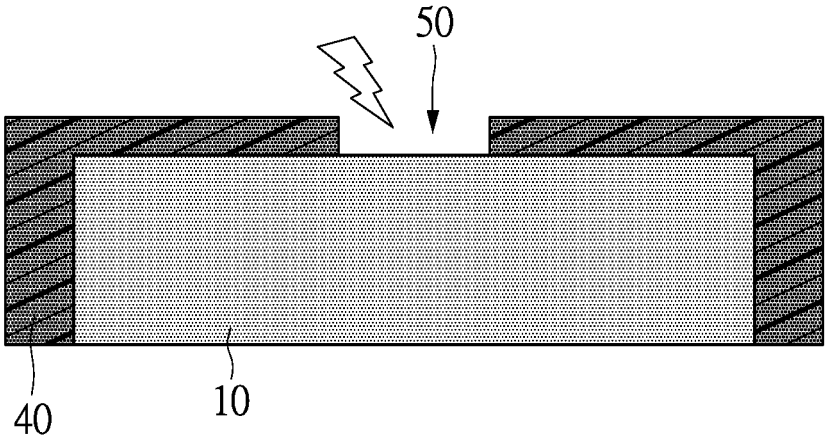
FIG. 3 is a cross-sectional view of a keyboard key structure of third embodiment according to the instant disclosure.

Refer to FIG. 3, which is a cross-sectional view of a keyboard key structure of third embodiment according to the instant disclosure. Different from the second embodiment, this embodiment can not only omit an outward layer, but also a character layer. The first color can be provided by the keycap body 10 itself. When the keycap body 10 is manufactured during an injection process, the keycap body 10 can be directly dyed the first color, which is the color of characters of symbols. Therefore, the character layer in the first embodiment can be omitted. The protecting layer 40 is directly spread on a top surface of the keycap body 10. The protecting layer 40 is dyed with the second color, which is the outer appearance color of the keycap. The protecting layer 40 can be a protecting layer of anti-ultraviolet rays or a protecting heat-resistant layer. Then, the laser engraving process can be applied to remove a part of the protecting layer 40 to form an engraving portion 50, so that the keycap body 10 with the first color is exposed outside the engraving portion 50. The material of the protecting layer 40 has characteristics such as high light-shading percentage, abrasion resistance, and is easily etched by laser. The protecting layer 40 can be added with 1% to 10% weight percent of laser-engraving assisted material, so as to process the laser engraving easily. The composition of the laser-engraving assisted material can be the same as mentioned in the first embodiment.

Fourth Embodiment

Figure 4:
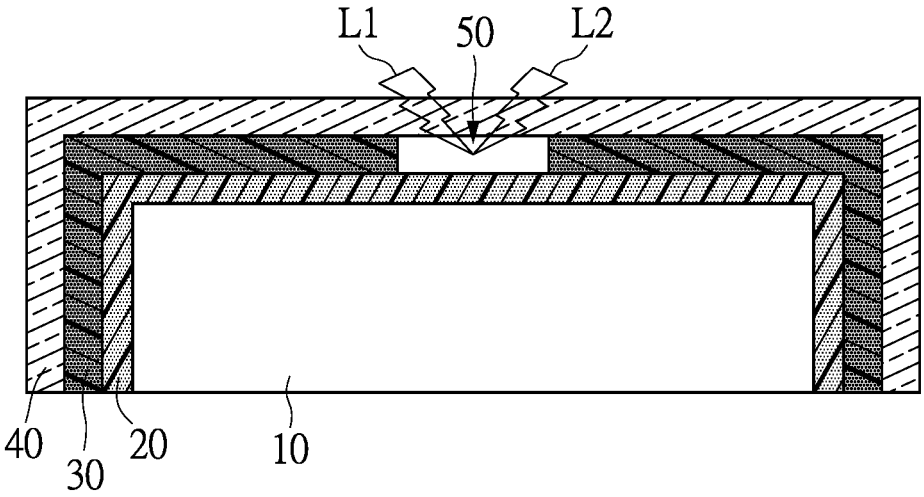
FIG. 4 is a cross-sectional view of a keyboard key structure of fourth embodiment according to the instant disclosure.

Refer to FIG. 4, which is a cross-sectional view of a keyboard key structure of a fourth embodiment according to the instant disclosure. The laminar structure of this embodiment is similar to that of the first embodiment, which includes a keycap body 10, a character layer 20 with the first color, an outward layer 30, and a protecting layer 40. The protecting layer 40 can be transparent. Different from the first embodiment, this embodiment has an engraving portion 50 formed between an inner surface of the protecting layer 40 and a top surface of the character layer 20, which passes downward through the outward layer 30.

In this embodiment, the protecting layer 40 preferably is made of laser-resistance material, cooperated with a slimmer outward layer 30. The thickness of the outward layer 30 could be slimmer than 5 μm. In addition, the protecting layer 40 can be added with 1% to 10% weight percent of chemical-resistance material, so that the chemical-resistance material can allow a laser to pass the protecting layer 40 without engraving or etching. the chemical-resistance material can be chosen from at least one of the following materials: inorganic particle (such as silicon dioxide, ceramic powder . . . etc.), Poly Methyl methacrylate (PMMA), polyurethane (PU), dispersant, antioxidant, UV Protecting Agents, organosilicon modified polyether, high-density oxidized polyethylene wax, carnauba wax, or polyethylene wax.

A further way of this embodiment can utilize sensitive ink to provide the first color of the character layer 20, such as optically variable ink, or thermochromic ink. When a laser is emitted to the keycap, the color of the ink is changed to another color.

This embodiment further provides a method of manufacturing a keycap of keyboard key, which comprises steps as follows:

Forming a keycap body 10 which has an appearance with a first color;

Forming a character layer 20 with the first color on an upper surface of the keycap body 10;

Forming an outward layer 30 which has an appearance with a second color different from the first color, and the outward layer 30 covers on the character layer 20;

Forming a transparent protecting layer 40, to cover on the outward layer 30; and Using a laser passing through the protecting layer 40 to engrave an engraving portion 50 on the outward layer 30. The engraving portion 50 is located between a bottom surface of the protecting layer 40 and a top surface of the character layer 30.

In this embodiment, the laser preferably is an ultraviolet laser with a center wavelength at 355 nm, or green laser with a center wavelength at 532 nm, or a laser with a center wavelength at 1064 nm.

In order to help the laser pass through the protecting layer 40 and reduce any damage to the protecting layer 40, in the method of this embodiment, a preferred manner can simultaneously use at least two beams of lasers L1, L2 to focus on the outward layer 30, and on where the engraving portion 50 is. The energy density of each laser beam is smaller than a critical value (or a threshold value) able to etch the protecting layer 40. Each laser beam's energy density is lower than the critical value able to etch the protecting layer 40, so that each laser beam will not damage the protecting layer 40 or reduce or damage the protecting layer 40 before reaching the outward layer 30. Since two laser beams are focused on the same place, the energy density of the laser beams can be added to etch the outward layer 30 and form the engraving portion 50. The two beams of lasers L1, L2 can enter into the protecting layer 40 in different angle of incidence.

This method also could use a single laser beam to achieve the same result in another way. If the protecting layer 40 has a larger thickness, this embodiment can use a single laser beam to pass the protecting layer 40 with a bigger light spot, whose energy density is not enough to etch the protecting layer 40. Then, the laser beam is properly focused on the outward layer 30 with a smaller light spot. A smaller light spot of the same laser beam has a bigger energy density, so as to form the engraving portion 50 on the outward layer 30.

During the laser etching the outward layer 30 to form the engraving portion 50, the scorched material may form smoke. A preferred manner of this embodiment can form a ventilation hole on the keycap in communication with air and the engraving portion 50, so that the smoke can be removed out by vacuuming or another similar way.

Fifth Embodiment

Figure 5:
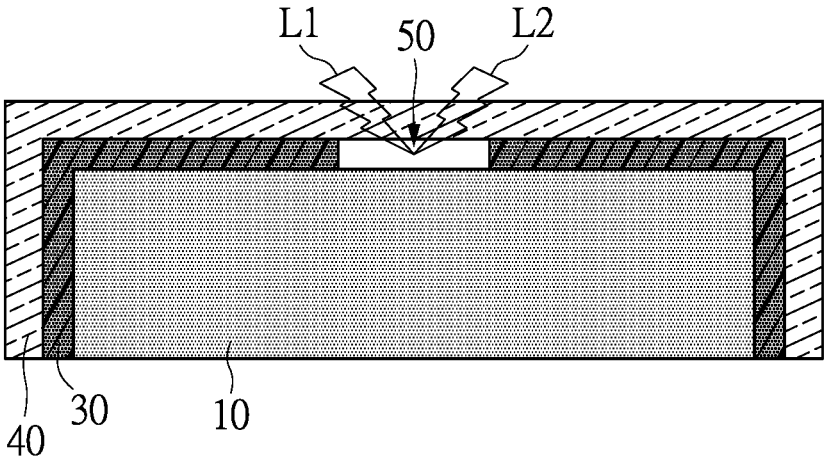
FIG. 5 is a cross-sectional view of a keyboard key structure of fifth embodiment according to the instant disclosure.

Refer to FIG. 5, which is a cross-sectional view of a keyboard key structure of a fifth embodiment according to the instant disclosure. Different from the fourth embodiment, this embodiment omits a character layer. The keycap has a keycap body 10, an outward layer 30, and a protecting layer 40. The protecting layer 40 can be transparent. The engraving portion 50 is arranged under an inner surface of the protecting layer 40, and passes through the outward layer 30 for exposing the first color.

The method of manufacturing the keyboard key according to this embodiment includes the steps as follows:

Forming a keycap body 10, which has an appearance showing a first color;

Forming an outward layer 30, which has an appearance showing a second color different from the first color, and the outward layer 30 is arranged above the keycap body;

Forming a transparent protecting layer 40, which covers on the outward layer 30; and Using a laser to pass the protecting layer 40 and engrave an engraving portion 50 on the outward layer 30, and the engraving portion 50 is under a bottom surface of the protecting layer 40.

This present disclosure has advantages as follows. The character layer 20 is preferably added with 1% to 10% weight percent of protective wear-resistant agent. Thus, the keycap can be protected and is not easily damaged during the laser engraving process, and passes an environmental test. Thus, the character layer 20 does not need an additional protecting layer for reducing a thickness of the keycap. Further, this present disclosure can omit a character layer, and even omit a protecting layer disposed outmost for reducing a thickness of the keycap. In addition, this present disclosure can form an engraving portion under the outmost protecting layer 40, and the keycap has no concaved engraving portion, with a more beautiful appearance.

The description above only illustrates specific embodiments and examples of the instant disclosure. The instant disclosure should therefore cover various modifications and variations made to the herein-described structure and operations of the instant disclosure, provided they fall within the scope of the instant disclosure as defined in the following appended claims.

What is claimed is:

1. A keyboard key structure having a plurality of keycaps, each of the keycaps comprising:

a keycap body providing a first color;

a character layer formed on an upper surface of the keycap body;

an outward layer having an appearance with a second color different from the first color, the outward layer being arranged above the character layer; and a transparent protecting layer, wherein the transparent protecting layer is formed on an outer surface of the outward layer;

wherein the outward layer is formed with an engraving portion therethrough, and the first color is exposed outside the engraving portion;

wherein the engraving portion is extended from an upper surface of the outward layer to an upper surface of the character layer;

wherein the upper surface of the character layer in the engraving portion is aligned to a bottom surface of the outward layer;

wherein the engraving portion further passes through the transparent protecting layer and is aligned to the engraving portion formed on the outward layer;

wherein the character layer, the outward layer and the protecting layer further cover a sidewall surface of the keycap body, and free ends of the character layer, the outward layer and the protecting layer not in contact with the sidewall surface are aligned with a bottom surface of the keycap body.

2. The keyboard key structure as claimed in claim 1, wherein the protecting layer is added with 1% to 10% weight percent of chemical resistant material to resist, wherein the chemical resistant material comprises at least one material selected from a group of materials consisting of: inorganic particles, sol-gel, polymethylmethacrylate (PMMA), polyurethane, dispersant, antioxidant, ultraviolet absorber, polyether-modified organic-silicones, oxidized high-density polyethylene wax, carnauba wax, and polyethylene wax.

3. The keyboard key structure as claimed in claim 1, wherein the character layer is added with 1% to 10% weight percent of protective wear-resistant agent.

4. The keyboard key structure as claimed in claim 1, wherein a thickness of the outward layer is slimmer than 5 μm.

5. The keyboard key structure as claimed in claim 1, wherein the protecting layer comprises at least one material selected from a group of chemical-resistance materials consisting of: chemical-resistance material: poly-methylmethacrylate (PMMA), polyurethane, dispersant, antioxidant, ultraviolet absorber, polyether-modified organic-silicones, oxidized high-density polyethylene wax, carnauba wax, and polyethylene wax.

6. A keyboard key structure having a plurality of keycaps, each of the keycaps comprising:

a keycap body having an appearance with a first color;

an outward layer having an appearance with a second color different from the first color, the outward layer being arranged above the keycap body; and a transparent protecting layer formed on an outer surface of the outward layer, wherein an engraving portion is formed by a laser passing through the outward layer and located between a bottom surface of the protecting layer and a top surface of the keycap body, but not passing through the protecting layer, to directly expose the first color through the transparent protecting layer with a background of the second color;

wherein the outward layer has an inner side surface arranged on a sidewall surface of the keycap body and a first edge surface between the inner side surface and the outer surface of the outward layer;

wherein the protecting layer has a second edge surface not contacting the outer surface of the outward layer, and the first edge surface and the second edge surface are aligned with a bottom surface of the keycap body.

7. The keyboard key structure as claimed in claim 6, wherein the laser is an ultraviolet laser with a center wavelength at 355 nm, or green laser with a center wavelength at 532 nm, or a laser with a center wavelength at 1064 nm.

8. The keyboard key structure as claimed in claim 6, further comprising a character layer, the character layer covered on a surface of the keycap body and having a first color, the outward layer covered on the character layer, the engraving portion is located between the bottom surface of the protecting layer and a top surface of the character layer.

9. The keyboard key structure as claimed in claim 6, wherein a thickness of the outward layer is slimmer than 5 and using the laser to etch the outward layer.

10. The keyboard key structure as claimed in claim 6, wherein the protecting layer is added with 1% to 10% weight percent of chemical resistant material to resist, wherein the chemical resistant material comprises at least one material selected from a group of materials consisting of: inorganic particles, sol-gel, polymethylmethacrylate (PMMA), polyurethane, dispersant, antioxidant, ultraviolet absorber, polyether-modified organic-silicones, oxidized high-density polyethylene wax, carnauba wax, and polyethylene wax.

11. The keyboard key structure as claimed in claim 6, wherein a thickness of the outward layer is slimmer than 5 μm.

12. The keyboard key structure as claimed in claim 6, wherein the protecting layer comprises at least one material selected from a group of chemical-resistance materials consisting of: chemical-resistance material: poly-methylmethacrylate (PMMA), polyurethane, dispersant, antioxidant, ultraviolet absorber, polyether-modified organic-silicones, oxidized high-density polyethylene wax, carnauba wax, and polyethylene wax.

13. A keyboard key structure having a plurality of keycaps, each of the keycaps comprising:

a keycap body;

a character layer providing a first color and being disposed on an upper surface and a sidewall surface of the keycap body;

an outward layer providing a second color darker than the first color and being disposed on the character layer; and a transparent protecting layer, wherein the transparent protecting layer is formed on an outer surface of the outward layer;

wherein a laser engraving portion passes from an outer surface of the protecting layer through the outward layer to an upper surface of the character layer, the outward layer has a first laser engraving contour in the laser engraving portion, the protecting layer has a second laser engraving contour in the laser engraving portion, and the first laser engraving contour and second laser engraving contour are aligned on a same plane;

wherein the outward layer has an inner side surface corresponding to the sidewall surface of the keycap body and a first edge surface between the inner side surface and the outer surface of the outward layer, and the first edge surface is aligned with a bottom surface of the keycap body.

14. The keyboard key structure as claimed in claim 13, the character layer, the outward layer and the protecting layer have free ends coplanar with a bottom surface of the keycap body.

15. The keyboard key structure as claimed in claim 13, wherein a thickness of the character layer, the outward layer and the protecting layer in a direction perpendicular to the sidewall surface of the keycap body is constant.

16. The keyboard key structure as claimed in claim 13, wherein a thickness of the character layer is less than a thickness of the protecting layer.

* * * * *